United States Patent [19]

Salesky et al.

[11] Patent Number: 4,593,776

[45] Date of Patent: Jun. 10, 1986

[54] ROCK BITS HAVING METALLURGICALLY BONDED CUTTER INSERTS

[75] Inventors: William J. Salesky, Huntington Beach; Gunes M. Ecer, Irvine; Karl O. Kuhn, Laguna Niguel, all of Calif.

[73] Assignee: Smith International, Inc., Newport Beach, Calif.

[21] Appl. No.: 744,826

[22] Filed: Jun. 14, 1985

Related U.S. Application Data

[63] Continuation of Ser. No. 594,449, Mar. 28, 1984, abandoned, which is a continuation-in-part of Ser. No. 544,923, Oct. 24, 1983, abandoned.

[51] Int. Cl.[4] ..... E21B 10/08

[52] U.S. Cl. ..... 175/375; 76/108 A; 419/8; 419/49

[58] Field of Search ..... 175/339, 374, 375, 407; 76/108 A, 101 E, 101 R, DIG. 6, DIG. 8; 419/8, 49; 428/553, 564

[56] References Cited

U.S. PATENT DOCUMENTS

| | | | |
|---|---|---|---|
| 1,803,882 | 5/1931 | Walter . | |
| 1,926,770 | 9/1933 | Harris et al. | 23/202 |
| 2,999,309 | 9/1961 | Kuzmick et al. | 29/194 |
| 3,294,186 | 12/1966 | Buell | 175/410 |
| 3,340,054 | 9/1967 | Ward et al. | 75/208 |
| 3,444,613 | 5/1969 | Foerster | 29/473.1 |
| 3,700,435 | 10/1972 | Chandhok | 75/214 |
| 3,804,575 | 4/1974 | Chandhok | 425/405 H |
| 3,970,158 | 7/1976 | Black et al. | 175/410 |
| 4,172,395 | 10/1979 | Keller | 76/108 A |
| 4,204,437 | 5/1980 | Espana | 76/108 A |
| 4,221,270 | 9/1980 | Vezirian | 175/329 |
| 4,249,621 | 2/1981 | Espana | 175/227 |
| 4,276,788 | 7/1981 | van Nederveen | 76/108 A |
| 4,350,215 | 9/1982 | Radtke | 175/329 |
| 4,358,384 | 11/1982 | Newcomb | 252/19 |
| 4,365,679 | 12/1982 | van Nederveen et al. | 175/371 |
| 4,368,788 | 1/1983 | Drake | 175/374 |
| 4,372,404 | 2/1983 | Drake | 175/374 |
| 4,389,074 | 6/1983 | Greenfield | 299/79 |
| 4,455,278 | 6/1984 | van Nederveen et al. | 419/6 |

FOREIGN PATENT DOCUMENTS

| | | |
|---|---|---|
| 0052584 | 10/1981 | European Pat. Off. . |
| 2916709 | 10/1980 | Fed. Rep. of Germany . |
| 449974 | 7/1936 | United Kingdom . |
| 2081347A | 8/1980 | United Kingdom . |

OTHER PUBLICATIONS

*Powder Metallurgy Design Guidebook,* by the Metal Powder Industries Federation, pp. 1–24.

Powder Metallurgy—Principles and Applications, *Cemented Carbides,* Chapter 16, pp. 383–399.

Powder Metallurgy—Principles and Applications, *Cermets,* Chapter 20, pp. 483–493.

Society of Manufacturing Engineers Technical Paper, *Powder Metallurgy Near Net Shapes by HIP,* MF82–344, 1982, pp. 1–15.

*Primary Examiner*—Stephen J. Novosad
*Assistant Examiner*—William P. Neuder
*Attorney, Agent, or Firm*—Gabor L. Szekeres

[57] ABSTRACT

A cladding process is disclosed wherein hard carbide cutter inserts, as well as polycrystalline diamond composites, are metallurgically bonded into an exterior core of a rock bit cone or a drag bit body. The cladding is bonded onto the exterior surface of the core of the cone or the drag bit by a powder metallurgy process. A thin layer or coating of a suitable metal, preferably nickel, is provided on, for example, the carbide inserts, prior to mounting into the core. The coating prevents degradation of the carbide through loss of carbon into the core during the powder metallurgy process and accommodates mismatch of thermal expansion between the cutter insert and the core.

57 Claims, 10 Drawing Figures

TWO STEP HIP FABRICATION OF SHEAR BIT

ROCK BITS HAVING METALLURGICALLY BONDED CUTTER INSERTS

BACKGROUND OF THE INVENTION

Cross-Reference to Related Applications

The present application is a continuation of application Ser. No. 594,449, filed on Mar. 28, 1984, now abandoned, which is itself a continuation-in-part of application Ser. No. 544,923 filed Oct. 24, 1983, now abandoned.

FIELD OF THE INVENTION

The present invention is directed to improvements in the construction of rock bits. More particularly, the present invention is directed to cutter cones of rock bits, including roller cone rock bits and drag bits, having metallurgically bonded cutter inserts.

BRIEF DESCRIPTION OF THE PRIOR ART

Roller cone rock bits used for drilling in subterranean formations when prospecting for oil, gas, or minerals have a main body which is connected to a drill string and a plurality, typically three, of cutter cones rotatably mounted on journals. The journals extend at an angle from the main body of the rock bit.

As the main body of the rock bit is rotated either from the surface through the drill string, or by a downhole motor, the cutter cones rotate on their respective journals. During their rotation, teeth provided in the cones come into contact with the subterranean formation and provide the drilling action.

Drag bits (or shear bits), on the other hand, are typically one piece, having no rotating parts. The cutting structure may include, for example, diamond chips embedded in a matrix on the cutting face of the bit, synthetic polycrystalline cutters mounted to the face of the bit body, or synthetic polycrystalline discs mounted to tungsten-carbide shanks, the shanks being subsequently interference fitted within complementary holes formed in the face of the drag bit body.

As is known, the subterranean environment is often very harsh. Highly abrasive drilling and is continuously circulated from the surface to remove debris of the drilling, and for other purposes. Furthermore, the subterranean formations are composed of rock with a wide range of compressive strength and abrasiveness.

Generally speaking, the prior art relative to roller cone rock bits has provided two types of cutter cones to cope with the above-noted conditions and to perform the above-noted drilling operations. The first type of drilling cone is known as a "milled-tooth" cone because the cone has relatively sharp cutting teeth obtained by appropriate milling of the cone body. Milled tooth cones generally have a short life span and are used for drilling in low compressive strength (soft) subterranean formations.

A second type of cutter cone, used for drilling in higher compressive strength (harder) formations, has a plurality of very hard cermet cutting inserts which are typically comprised of tungsten-carbide and are mounted in the cone to project outwardly therefrom. Such a rock bit having cutter cones containing tungsten-carbide cutter inserts is shown, for example, in U.S. Pat. No. 4,358,384 wherein the general mechanical structure of the rock bit is also described.

The cutter inserts, which typically have a cylindrical base, are usually mounted through an interference fit into matching openings in the cutter cone and the drag bit face. This method, however, of mounting the cutter inserts to the cone and within holes formed in the drag bit face is not entirely satisfactory because the inserts are often dislodged from the cone or the drag bit face by fluid particle erosion of body material, excessive force, repetitive loadings or shocks which unavoidably occur during drilling.

Another problem encountered in the manufacture of rock bits relates to the number of machining and other steps required to fabricate the cutter cone. Conventional cutter cones are fabricated in several machining operations which are, generally speaking, labor intensive and expensive.

Furthermore, the internal portion of the cutter cone includes a friction bearing wherethrough the cone is mounted to the respective journal. It also includes bearing races for balls to retain the cone on the journal. These internal bearing surfaces of the cone must be sufficiently hard to avoid undue wear and to support the loads encountered in drilling. To accomplish this, it has been customary in the prior art to selectively carburize certain pre-machined internal surfaces of the cone.

U.S. Pat. Nos. 4,249,621 and 4,204,437 disclose developments in the art wherein the entire cutter cone, rather than only selected surfaces thereof, are carburized to receive a relatively thin but hard case.

In an effort to improve the attachment of the cutter inserts to the cutter cones and to the face of a drag bit, the prior art has devised various techniques. For example, U.S. Pat. No. 4,389,074 describes brazing tungsten-carbide-cobalt inserts into a mining tool with a brazing alloy consisting essentially of 40 to 70 weight percent copper, 25 to 40 weight percent manganese, and 5 to 15 weight percent nickel. Similarly, U.S. Pat. No. 3,294,186 describes mounting tungsten-carbide-cobalt inserts into rock bit cones, using a layer of brazing alloy, a nickel shim, and yet another layer of the brazing alloy.

Relative to drag bits, U.S. Pat. No. 4,350,215 describes a drag bit that includes a plurality of cutter assemblies comprising synthetic polycrystalline diamonds which are held by brazing material within dimensionally controlled pockets formed in the drill bit matrix. The method of manufacturing the bit includes forming the drill bit head by conventional matrix bit technology with a plurality of dimensionally controlled pockets, placing brazing material in communication with each pocket, locating and fixturing a cutter assembly within each pocket by force fit, and brazing the cutter assemblies to the bit head by a furnace cycle.

The present invention is advantaged over U.S. Pat. Nos. 4,350,215, 4,389,074, and 3,294,186 in that the diffusion bond between the cutter and the cone and/or drag bit body is of greater physical strength and is of superior abrasion and erosion wear resistance. The superior quality and performance of the bond established in the present invention is related to the diffusion bonding of an iron-based matrix to a cemented carbide, being of both chemical as well as mechanical character, whereas that taught in the above-named patents is a brazed bond which is inherently mechanical and of lesser material strength. Further, U.S. Pat. Nos. 4,389,074 and 3,294,186 teach the use of copper-based brazes which is a disadvantage since as the drilling depth increases, so does the temperature, such that the strength of a copper-based braze would degrade or decrease, leading to the premature loss of cutters—a significant disadvantage relative to the present invention, especially at large depths.

Still other techniques of affixing tungsten-carbide inserts to drill bodies, tools, and the like are described in U.S. Pat. Nos. 1,926,720 and 3,970,158.

U.S. Pat. No. 4,276,788 discloses an entire cutter cone fabricated by placing metal powders in a rubber mold, cold isostatically compressing to an intermedial shape, followed by hot isostactic pressing, to form a solid cutter body. A disadvantage of the cutter cone in U.S. Pat. No. 4,276,788 is that it is both more complicated to fabricate and more expensive than the present invention because it requires *both* cold pressing and hot pressing to form the part due to the use of a rubber mold; whereas the present invention, through the use of a ceramic mold technique, which allows direct hot isostatic or hot pressing of the part from metal powders to a solid part, thereby eliminates the cold isostatic pressing requirement, and consequently reduces cost. A further disadvantage of U.S. Pat. No. 4,276,788 is that it lacks a tough, shock-resistant core, even though such a core is desirable to avoid core fracture during drilling.

U.S. Pat. Nos. 4,365,679 and 4,368,788 disclose cutter cones fabricated utilizing metal powders formed into solid bodies. A disadvantage of U.S. Pat. No. 4,365,679 is that the cutter cone formed by cold isostatic pressing requires a plasma spray, wear resistant coating prior to hot isostatic pressing to densify the body—wherein the present invention has both an abrasion resistant exterior and a ductile interior formed in one consolidation step.

U.S. Pat. No. 4,368,788 discloses forming a cutter cone by mixing abrasion resistant and ductile powders to form a cutter having an abrasion resistant exterior and a ductile interior. A major advantage of the present invention over U.S. Pat. No. 4,368,788 is the greater dimensional control of the overall cone shape, achieved due to the small ratio of powder to solid. In an all-powder cutter, non-uniform and non-reproducible shrinkage during consolidation will lead to large dimensional variations, avoided by the present invention.

Further, in U.S. Pat. No. 4,368,788, the "mixing" of "hard" and "soft" powders to form a composite to avoid a "metallurgical notch" will lead, in the case of tungsten-carbide insert bits, to a co-mingling of the powders such that, for adequate consolidation and consequent performance, the required liquid phase sintering temperatures will cause intermingling to such an extent that no gradient will be observable. The present invention is advantaged in that a metallurgical notch is avoided by the matching of linear thermal expansion coefficients (through alloy selection) of the exterior abrasion resistant layer and the ductile cone core. In the present invention, relative to tungsten-carbide inserts diffusion bonded to the cone, a coating is applied to accommodate the expansion coefficient mismatch and to prevent carbide degradation during processing.

U.S. Pat. No. 4,221,270, assigned to the same assignee as the present invention, discloses a rotary drag bit that includes a replaceable head cover which is adapted to be removably attached to the face and gage surfaces of the bit body head portion. The head cover is made of tungsten-carbide and includes a plurality of projections integrally formed thereon. These projections function as a backing, and include a planar surface for receiving a plurality of synthetic diamond discs which are bonded thereto. The tungsten-carbide head cover functions as a wear surface around the bases of the cutting elements to prevent erosion thereof. This invention mechanically joins the tungsten-carbide "cap" to the underlying steel drag bit body.

Thus, none of the prior art processes are entirely satisfactory from the standpoint of providing rock bit cutter cones and drag bit bodies with sufficient ability to retain the cutting structure (including insert type cutters) under severe load conditions.

The present invention, however, solves the above-noted problems.

SUMMARY OF THE INVENTION

It is an object of the present invention to provide a cutter cone for a rock bit or a drag bit body, wherein hard cutting inserts are affixed to the cutter cone or face of the drag bit by metallurgical bond.

It is another object of the present invention to provide a cutter cone for a rock bit and a drag bit face with cutting structures in the matrix of the face of the bit, wherein inadvertent degradation of cutter inserts is avoided during fabrication of the cones and the drag bit.

It is still another object of the present invention to provide a cutter cone for a rock bit and a drag bit body which has a tough resilient core and a hard outer cladding obtained by a powder metallurgy process.

It is still another object of the present invention to provide a cutter cone for a rock bit and a face of a drag bit which has an outer cladding embedding hard cutting inserts and which attains a near-net exterior shape after the cladding is bonded to an underlying core by a powder metallurgy process.

It is yet another object of the present invention to provide a drag bit which the tungsten-carbide cutter supports, metallurgically bonded by the drag bit face, joined to polycrystalline diamond blanks in a separate processing operation—the purpose of the diamond blanks being to provide a highly wear resistant rock cutting surface.

These and other objects and advantages are attained by a cutter cone and a drag bit body which have a tough shock-resistant core, and hard, cutting inserts fitted in cavities or projections provided in the core or matrix face of the bit. A hard cladding is disposed on the outer surface of the cone or drag bit face, having been metallurgically bonded thereto in a suitable mold by a powder metallurgy process.

Preferably, metallurgical bonding of the cladding occurs through hot isostatic pressing. The cutting inserts and/or drag bit studs are also metallurgically bonded to the core and to the cladding as a result of the formation of the cladding through hot isostatic pressing or like powder metallurgy processes.

With respect to rotary cone rock bits, the interior of the cone incorporates conventionally machined bearing surfaces and races for attachment of the cutter cone to a respective journal of the rock bit. As a preferred alternative, however, the bearing surfaces and bearing races are formed in the interior of the cone from a metal powder or cermet, in the same or similar powder metallurgical bonding process, wherein the exterior cladding is bonded and hardened. As still another alternative, the bearing surfaces are formed in a separate piece which is subsequently affixed into a bearing cavity provided in the core.

In order to prevent degradation of the cemented carbide cutting inserts for rock bit cones and cemented carbide studs for drag bits into undesirable "eta" phase, by diffusion of carbon from the insert into the underlying core during the powder metallurgical bonding process, and to accommodate the mismatch in thermal expansion coefficients between the cutting insert and the ferrous core body, a thin coating of a suitable material is deposited on the inserts prior to placement of the inserts into corresponding cavities in the core. Examples of such material are copper, copper alloys, silver, silver alloys, cobalt, cobalt alloys, tantalum, tantalum alloys, gold, gold alloys, palladium, palladium alloys, platinum, platinum alloys, and nickel or nickel alloys.

Another alternative to prevent degradation of the cutting inserts is to provide an alternative source of carbon, such as a graphite layer, in the vicinity of the cutting inserts.

With regard to drag or shear bits, the preferably mild steel core of the bit body has machined therein a chamber to admit hydraulic fluid ("mud") that is directed through one or more nozzles strategically placed in the cutting face of the drag bit body. The interior walls of the chamber may be cladded with metal powder or cermet in a manner similar to the powder metallurgical bonding process of the interior bearing surfaces of the rock bit cones. An alternative to simply cladding the walls of the nozzles in the drag bit body is to form the nozzles such that the cladding initially fills the nozzle bore, which is later machined to the proper diameter. In this alternative, it is preferable that the hardness of the cladding prior to machining be reasonably soft, preferably less than 40 Rockwell C.

With regard to drag matrix or shear bits, the fabrication cycle is preferably a combination of stud formation and/or bonding in association with the attachment of polycrystalline diamond (PCD) pieces to the studs or projections in the drag or matrix bit face in a second, separate lower temperature/pressure HIPping cycle. The purpose of this second lower temperature/pressure cycle is both to prevent degradation of the PCD, while permitting the preferred HIP bond to be established between the PCD and the stud or supporting projection in the bit face.

The features of the present invention can be best understood, together with further objects and advantages, from the following description, taken together with the appended drawings, wherein like numerals indicate like parts.

DESCRIPTION OF THE PREFERRED EMBODIMENTS AND BEST MODE FOR CARRYING OUT THE INVENTION

The following specification, taken in conjunction with the drawings, set forth the preferred embodiments of the present invention. The embodiments of the invention disclosed herein are the best modes contemplated by the inventors for carrying out their invention in a commercial environment, although it should be understood that various modifications can be accomplished within the parameters of the present invention.

Figure 1:
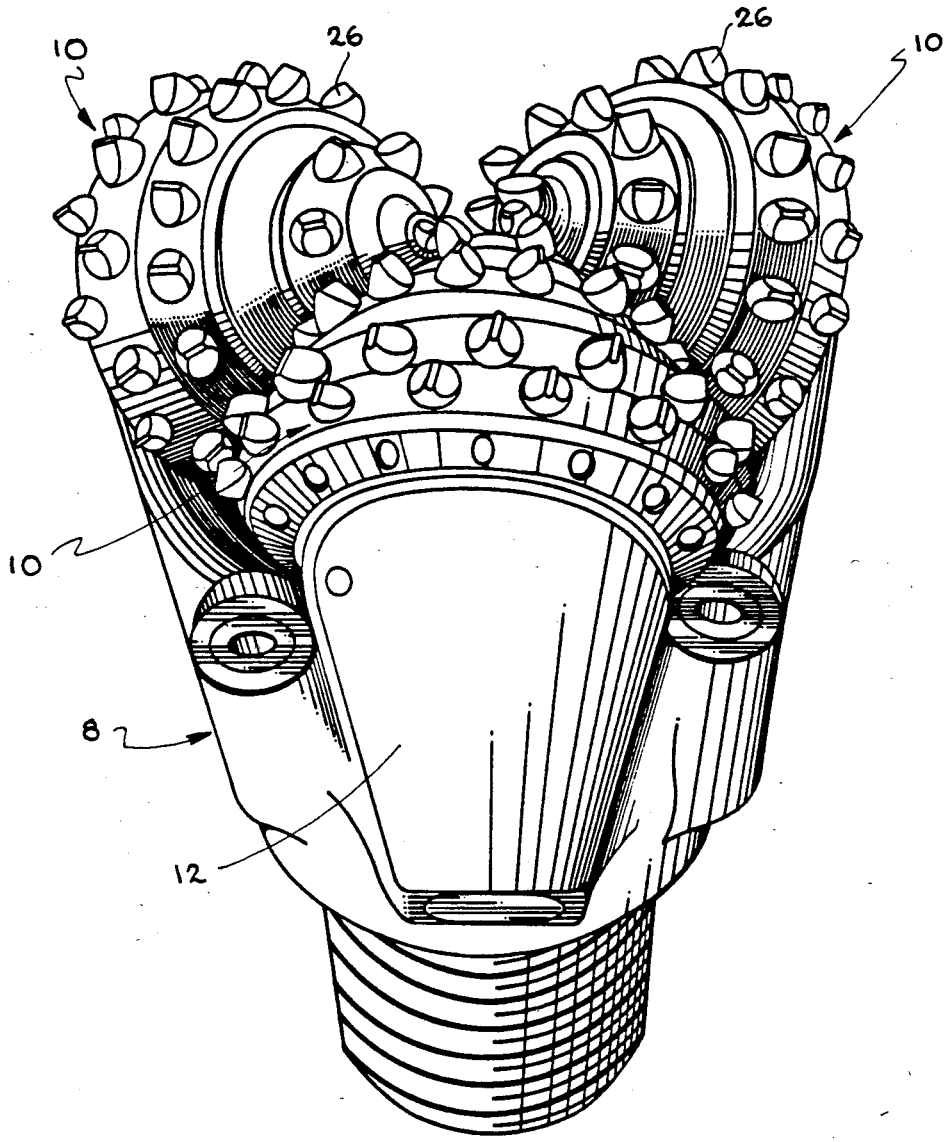
FIG. 1 is a perspective view of a rock bit incorporating the cutter cone of the present invention.
Figure 2:
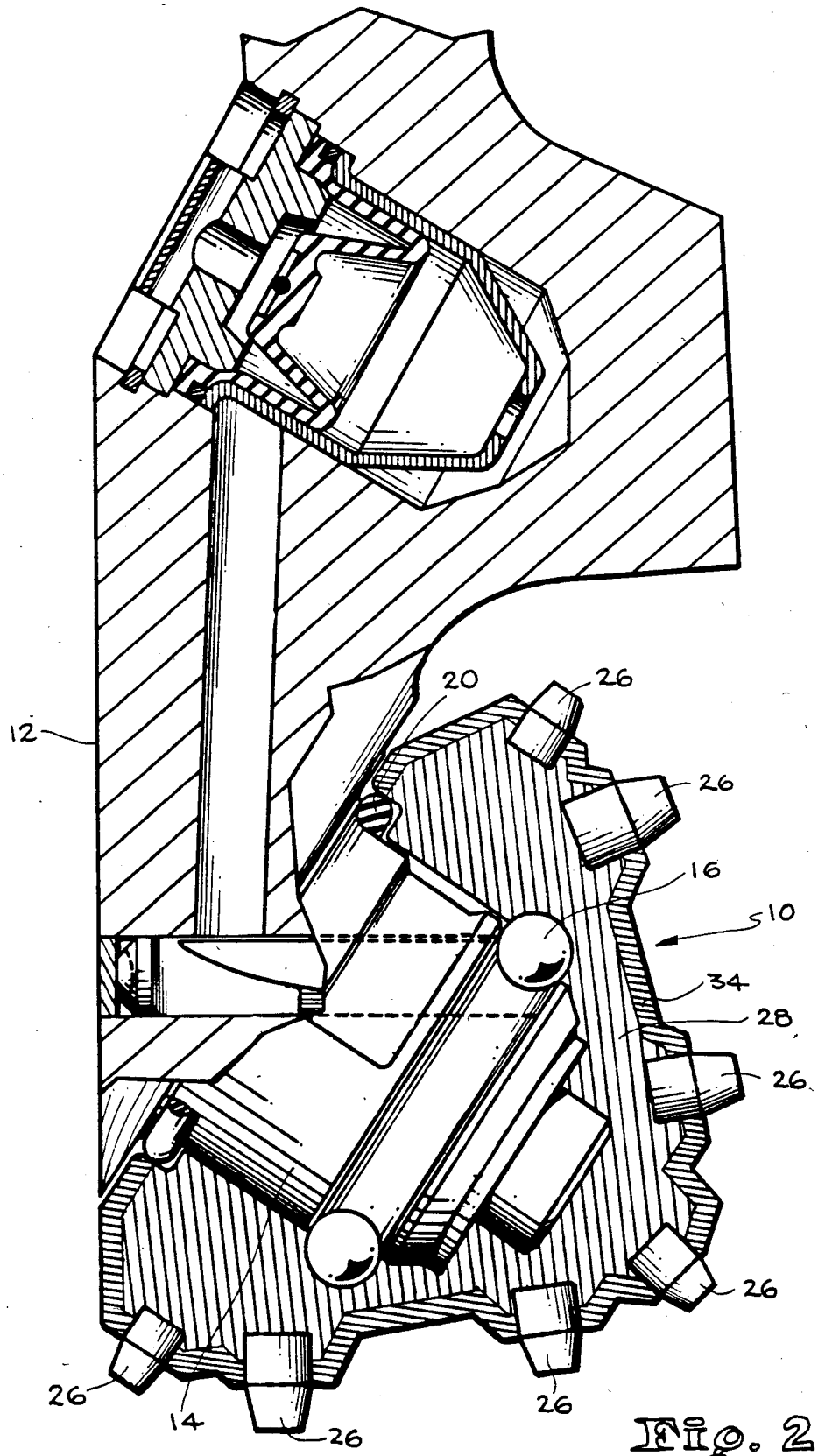
FIG. 2 is a cross-sectional view of a journal leg of a rock bit with the cutter cone of the present invention mounted thereon.

Referring now to the drawing figures, the perspective view of FIG. 1 shows a rolling cone rock bit 8 wherein a cutter cone of the present invention is mounted. The cross-sectional view of FIG. 2 shows mounting of a first embodiment of the cutter cone 10 of the present invention to a journal leg or journal 12 of the rock bit 8.

It should be noted at the outset that the mechanical configurations of the rock bit 8, the journal 12, and of the cutter cone 10 are conventional in many respects and therefore need to be disclosed here only to the extent that they differ from well-known features of conventional rock bits. For a description of the conventional features of a rolling cone rock bit, the specification of U.S. Pat. No. 4,358,384 is incorporated herein by reference.

For the purpose of explaining the several features of the present invention, it is deemed sufficient to note that in conventional rolling cone rock bit construction, internal friction bearing surfaces 14 and ball races 16 are lubricated by an internal supply of a lubricant (not shown). Of course, with respect to the drag bit shown in FIG. 7, there is no lubricant supply. The bearing surfaces 14 and ball races 16 are sealed from extraneous material, such as drilling mud and drilling debris, by a suitable seal, such as an elastic O-ring seal 20. The conventional internal bearings are usually of the "hard-on-soft" type; e.g., a hard metal bearing surface of the journal 12 engages a bronze bearing surface 24 of the cutter cone 10.

Furthermore, in conventional cutter cone construction, as well as some drag bit construction, a plurality of tungsten-carbide-cobalt (cermet) cutter inserts 26 (or diamond-tipped insert studs common in drag bits) are interference-fitted into corresponding circular holes which are drilled individually in the cutter cone 10 or the cutting face of a drag bit. This procedure is not only labor intensive, but provides a cutter cone or drag bit which has, under severe drilling conditions, less than adequate retention of the cutter inserts 26.

Figure 3:
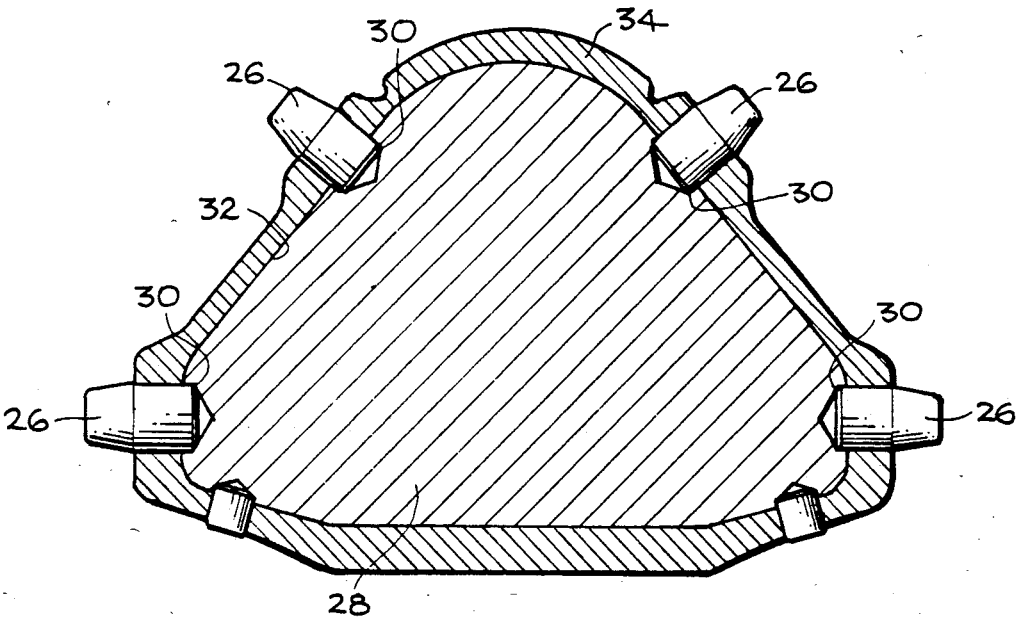
FIG. 3 is a schematic cross-sectional view of an intermediate in the fabrication of the cutter cone of the present invention, the intermediate having a solid core.

Referring now principally to FIG. 3, a solid core 28 of the cutter cone 10 is shown in accordance with the first embodiment of the present invention. The core 28 comprises tough shock-resistant steel, such as mild steel; for example, A.I.S.I. 9315 steel or A.I.S.I. 4815 steel. In alternative embodiments, the core 28 itself may be made by powder metallurgy techniques but used in the solid form prior to applying the teachings of this invention.

In accordance with the present invention, a plurality of cavities 30 are provided in the outer surface 32 of the core 28 to receive, preferably by a slip fit, a plurality of cutter inserts 26. The cavities 30 may be configured as circular apertures, shown on FIG. 3, but may also comprise circumferential grooves (not shown) on the exterior surface 32 of the core 28. Furthermore, the cutter inserts 26 may be of other than cylindrical configuration. They may be tapered, as is shown on FIG. 5, or may have an annulus (not shown) comprising a protrusion. Alternatively, the inserts may be tapered and oval in cross-section. What is important in this regard is that the cutter inserts 26 are positioned into the cavities 30 without force fitting, or without the need for fitting each individual insert 26 into a precisely matching hole, thereby eliminating significant labor and cost.

The cutter inserts 26 are typically made of hard cermet material. In accordance with usual practice in the art, the cutter inserts comprise tungsten-carbide-cobalt cermet. However, other cermets which have the required hardness and mechanical properties may be used. Such alternative cermets are tungsten-carbide in iron, iron-nickel, and tungsten-carbide in iron-nickel-cobalt matrices. In fact, tungsten-carbide-iron based metal cermets often match better with the thermal expansion coefficient of the underlying steel core 28 than the tungsten-carbide-cobalt cermets.

Subsequent to positioning the cutter inserts 26 into the cavities 30, a powdered metal or cermet composition is applied to the exterior surface 32 of the core 28 to eventually become a hard exterior cladding of the cutter cone 10.

Figure 7:
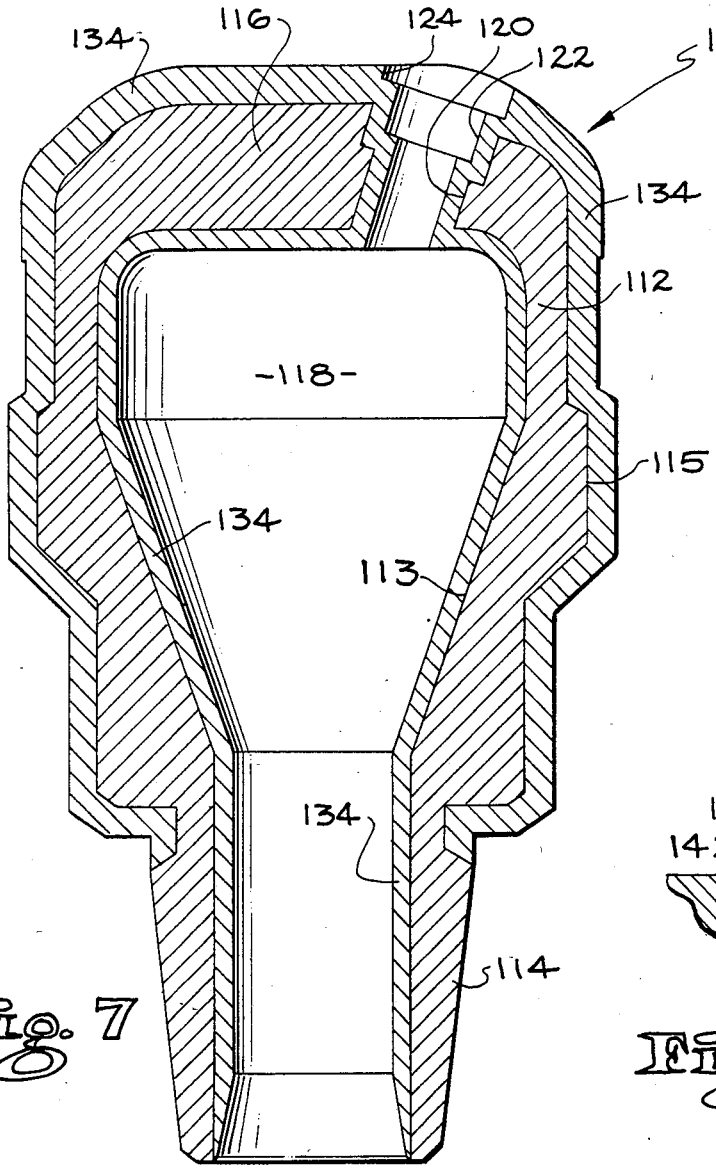
FIG. 7 is a cross-sectional view of a typical drag bit body.

The metal or cermet composition is schematically shown on FIG. 3 as a layer or cladding, bearing the reference numeral 34. The composition is also shown in FIG. 7 (134) without the insert 26 bonded therein. As is explained below, one function of the cladding is to retain the insert 26 in the core 28.

Referring now specifically to FIG. 7, the drag bit core, generally designated as 128, consists of a machined steel forging or body 112. The body is preferably fabricated from 9315 material. However, the body could be forged from a 4000 series mild steel, such as 4120, 4310, 4320, or 4340. These materials would be interchangeable with 9315 steel. Regardless of the material from which the core is made, the pin end 114 (the end that threadably engaged a drill string) must be protected from the cladding process 134 to facilitate the pin threading operation (not shown).

A nozzle bore 120 may be provided in the head or face end 116 of body 112. The internal surface of the cylinder bore 120 may or may not be cladded with the cladding material 134, depending upon the type of hydraulic nozzle to be secured within the bore.

A preferable alternative to cladding the nozzle bore 120 is to form the drag bit body such that the intended nozzle is completely filled with cladding material after consolidation in such a manner that, after consolidation, the cladding is sufficiently soft (preferably less than 40 Rockwell C), such that the bore could be readily machined.

As stated heretofore, the cladding thickness may be varied on the exterior surface 115 of the core body 112 as well as the interior surface 113 that forms internal chamber 118.

The metal or cermet composition comprising the cladding must satisfy the following requirements. It must be capable of being hardened and metallurgically bonded to the underlying core 28/128 to provide a substantially one hundred percent dense cladding of a hardness of at least 50 Rockwell C units. Many tool steel and cermet compositions satisfy these requirements. For example, commercially available, well-known A.I.S.I. D2, M2, M42, and S2 tool and high-strength steels are suitable for the cladding. An excellent cladding for the present invention is the tool steel composition which consists essentially of 2.45 weight percent carbon, 0.5 percent manganese, 0.9 percent silicon, 5.25 percent chromium, 9.0 percent vanadium, 1.3 percent molybdenum, 0.07 percent sulfur, with the remainder of the composition being iron. This composition is well known in the metallurgical arts under the CPM-10 V designation of the Crucible Metals Division of Colt Industries. Still another excellent cladding material is a proprietary alloy of the above-noted Crucible Metals Division, known under the Development Number 516,892.

Instead of powdered steel compositions, such powdered cermets as tungsten-carbide-cobalt (WC-Co), titanium-carbide-nickel-molybdenum (TiC-Ni-Mo), or titanium-carbide-iron alloys (Ferro-Tic alloys) may also be used for the cladding 34/134.

The application of the powdered material of the cladding 34/134 and metallurgical bonding to the underlying core 28/128 and its subsequent hardening are performed in accordance with well-known powder metallurgy processes and conventional heat treatment practices. Although these well-known processes need not be disclosed here in detail, it is noted that the powder metallurgy processes suitable for use in the present invention include the use of a ceramic molding process (not shown) which determines the exterior configuration of the cutter cone 10 and the drag bit 100.

Furthermore, the powder metallurgy process involves application of high pressure to compact the powder and heating the powdered cladding in the ceramic mold (not shown) at a high temperature—but below the melting temperature of the powder—to transform the powder into dense metal, or cermet, and to metallurgically bond the same to the underlying core 28/128. Thus, the cladding 34/134 incorporated in the cutter cone 10 and the drag bit 100 of the present invention may be obtained by cold pressing or cold isostatic pressing the powdered layer 34/134 on the core 28/128, followed by a step of sintering.

A preferred process for obtaining the hard cladding 34/134 for the cutter cone 10 and drag bit 100 of the present invention is, however, hot isostatic pressing (HIPping). Details of this process, including the preparatory steps to the actual hot isostatic pressing of the cutter cone 10 and drag bit 100, are described in U.S. Pat. Nos. 3,700,435 and 3,804,575, the specifications of which are hereby expressly incorporated by reference. When the Crucible CPM-10 V powdered steel composition is used for the cutter cone 10 and drag bit 100 of the present invention, the hot isostatic pressing step is preferably performed between approximately 1900° to 2200° Fahrenheit, for approximately 4 to 10 hours, at approximately 15,000 to 30,000 psi.

An ideal temperature for the pressing cycle is 2150°±25° Fahrenheit, at a pressure of 15,000±500 psi for 8 hours.

Figure 8:
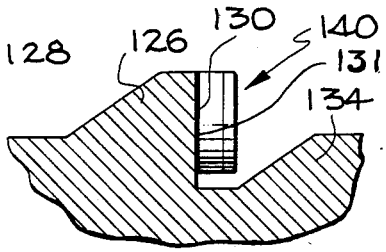
FIG. 8 is a view of a synthetic polycrystalline disc mounted to a protrusion formed in the powder metallurgically formed face of the drag bit.
Figure 9:
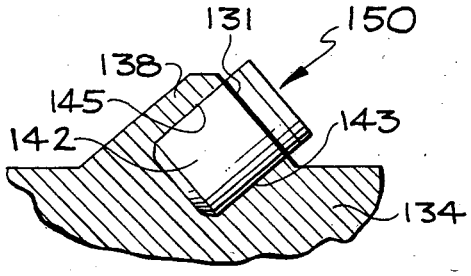
FIG. 9 is an alternative embodiment wherein a polycrystalline disc is bonded to a tungsten-carbide stud, the stud being interference fitted or metallurgically bonded within a complementary recess in the face of the drag bit.

With reference to FIGS. 8 and 9, the protrusions 126 and 138 are formed in the powder metallurgy mold to provide a means to mount, for example, polycrystalline diamond discs, generally designated as 140 (FIG. 8). These discs, as well as the diamond tipped insert studs referred to earlier, are fabricated from a tungsten-carbide substrate, the diamond layer being composed of a polycrystalline material. The synthetic polycrystalline diamond layer (PCD) is manufactured by the Specialty Material Department of General Electric Company of Worthington, Ohio. The foregoing drill cutter blank is known by the trademark name of STRATAPAX drill blank.

The diamond capped tungsten-carbide stud, generally designated as 150, is provided with a complementary non-interference sized hole in protrusion 138 (FIG. 9) so that the insert 150 may be metallurgically bonded to the cladding 134 on face 116 of core body 112.

Figure 10:
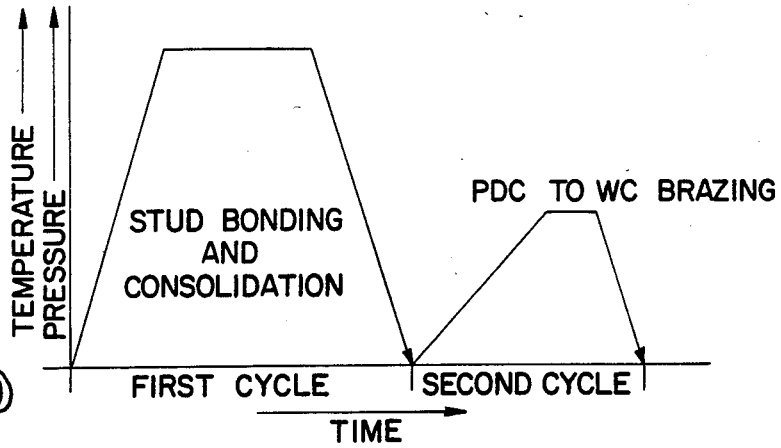
FIG. 10 is a chart illustrating the preferred fabrication cycle to fabricate the drag bit. The first cycle is used to form and/or bond the cladding and/or the studs to the drag bit face. The second cycle is used for bonding the polycrystalline diamond pieces to the studs and/or projection in the bit face.

Since polycrystalline diamond discs are preferred as a cutting structure for drag or shear bits, two separate hot isostatic pressing cycles may be required as is illustrated in FIG. 10. The first high-temperature/high-pressure cycle consolidates the cladding 34/134 to the core body 112 and bonds, for example, the tungsten-carbide studs 142 (FIG. 9) within the cladding material. When Crucible CPM-10V powdered steel composition is used during the first HIPping cycle for the drag bit 100 of the present invention, the hot isostatic pressing step is preferably performed between approximately 1900° to 2200° Fahrenheit, for approximately 4 to 10 hours, at approximately 15,000 to 30,000 psi.

After the hot isostatic pressing step, certain further heat treatment steps well known in the art, such as quenching and tempering, may be performed on the cutter cone 10 and drag bit 100. The conditions for quenching and tempering are preferably those recommended by the suppliers of the powdered steel composition which is used for the cladding 34/134.

Alternatively, for drag bits, once the cladding is consolidated, a sufficiently hard (greater than 50 Rockwell C) and abrasion-resistant surface layer may be obtained by rapid cooling the bit, thereby requiring no further heat treatment. Such a cooling cycle is typically available in hot isostatic cooling units equipped with a convective cooling device. A cold inert gas flow may also adequately cool the bit.

The second cycle (less temperature and pressure) serves to metallurgically bond the PCD (polycrystalline diamond) disc 140 to the cladding material (130, FIG. 8) or the disc 150 to the tungsten-carbide stud 142 (130, FIG. 9). In FIGS. 8 and 9, a nickel shim 131 may be used to bond the PCD discs 140/150 to the protrusion 126 or to the tungsten-carbide stud body 142 (FIG. 9). Where the nickel shim is used as a diamond bonding agent, the temperature should be between 1200° (650° C.) and 1385° (750° C.) Fahrenheit, at a pressure between 15,000 to 30,000 psi for 0.5 to 4 hours. The preferred conditions for this bonding process are 1200° Fahrenheit at 15,000 psi for about 2 hours.

Where the PCD discs 140/150 are silver brazed to the protrusion 126 or to the stud body 142, a temperature of about 650° Fahrenheit, at pressures ranging from 15,000 to 30,000 psi, will accomplish the task. It should be emphasized that the process as outlined above will work equally well for both the steel projections 126 and the tungsten-carbide studs 142.

Referring still principally to FIGS. 2, 3, and 7, the cutter cone 10 and drag bit 100, obtained in the above-described manner, has an exterior configuration which corresponds to the final, desired configuration of the cutter cone 10 and drag bit 100 usable in a rock bit. In other words, little, if any, machining is required on the exterior of the cutter cone 10 and drag bit 100 obtained in accordance with the present invention. Uniform thickness of the cladding is preferable with respect to the cone 10, however, it could well be an advantage to clad the head 116 of drag bit body 112 heavier or thicker than the cladding on the rest of the body for extended performance. The cladding on the cone 10 may, for example, be ⅛" (0.125") thick. The cladding on the head 116 of the drag bit could, for example, be 3/16" (0.187") thick, while the rest of the drag bit body 112 (with the exception of the threaded pin end 114) could be ⅛" thick. The walls 113, forming chamber 118, could be uniformly cladded to the thickness of the drag bit body 112 or the cladding 134 on walls 113 may be thinner than the exterior cladding, since the interior of the bit is subjected to less abrasive action than the exterior surfaces of drag bit 100.

A further, very significant advantage is that the cutter inserts 26/150 and diamond disc 140 are affixed to the core 28/128 and to the cladding 34/134 by metallurgical bonds. Experience has shown that, for example, a tungsten-carbide-cobalt insert 26 (of the size normally used for roller cone rock bits, having an 0.5" diameter and an 0.310" "grip") affixed to the cutter cone 10 in accordance with the present invention requires, on the average, a pulling force in excess of 21,000 pounds to dislodge the insert from the cone 10. In contrast, conventional interference-fitted inserts are dislodged from the cone 10 by a force of approximately 7,000 to 10,000 pounds.

Similarly, for drag bits, the metallurgical bonding of the studs and/or projections into the bit face is a substantial advantage over present art. Typically, drag bit studs/cutters, interference fitted into holes in the bit face, are lost in service through erosion of the bit face being especially aggressive at the base of the cutters, such that a substantial portion of the grip length of the stud/cutter can be eroded away. The loss of these studs/cutters in service not only decreases the rate of drilling, but introduce highly undesirable and difficult debris into the well which, if not removed, will damage and/or destroy every bit put into the well afterward. Therefore, the metallurgical bonding of the studs into the bit face will significantly reduce the frequency of stud/cutter loss, thereby increasing the overall life of the drag bit as well as decreasing the likelihood of an expensive fishing operation, necessary to remove debris from the hole.

The cladding 34/134 of the cone 10 and the drag bit 100, obtained in accordance with the present invention, is substantially one hundred percent (99.995%) dense, and has a surface hardness of at least 50 Rockwell C units.

The interior of the solid intermediate cutter cone 10, shown on FIG. 3, may be machined independently of the hot isostatic pressing process to provide the cutter cone interior, shown on FIG. 1. Alternatively, the core 28 itself may be formed by powder metallurgy in steps separate from the above-described steps. Furthermore, conventional bearing surfaces (for example, aluminum-bronze) or hard metal bearings (for example, cobalt-based hard facing alloys) may be applied into the interior of the cone 10 in accordance with the state of the art.

As still another alternative, the bearing surfaces may be formed separately from the fabrication of the core 28. In this case, a separate bearing insert piece (not shown) is fitted into the hollow core.

Figure 4:
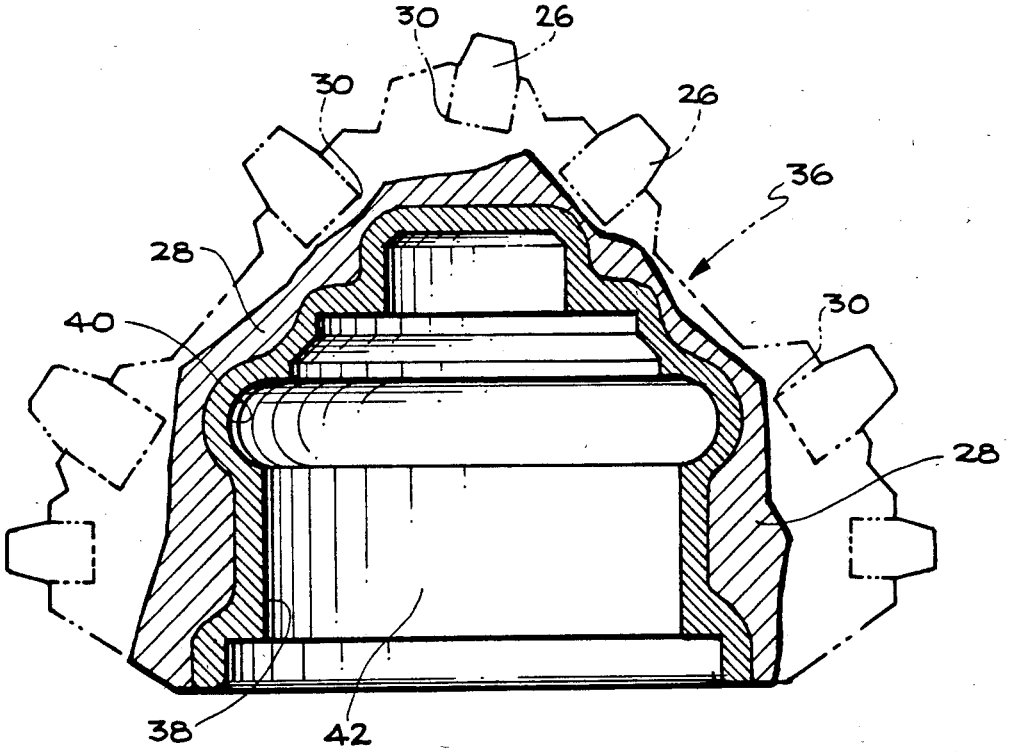
FIG. 4 is a schematic cross-sectional view of an intermediate in the process of fabricating another embodiment of the cutter cone of the present invention.

Referring now to FIG. 4, a second embodiment of the cutter cone 36 of the present invention is shown. This embodiment has interior bearing surfaces 38 and races 40 obtained by a powder metallurgy process, preferably a process including a hot isostatic pressing step. Thus, in order to obtain the cutter cone 36, shown on FIG. 4, a mild steel core is provided by a machined interior cavity or opening 42 and a plurality of exterior cavities or apertures 30. The exterior apertures 30 receive cutter inserts 26 in a slip fit, as it was described in connection with the first embodiment of the present invention. The exterior cladding 34 is applied to the core 10 in the manner described in connection with the first embodiment.

However, simultaneously with, or subsequent to, the powder metallurgy process wherein the cladding 34 is bonded, a powdered metal or cermet composition is also bonded in the interior cavity 42 through a powder metallurgy process to provide the bearing races 40 and bearing surface 38. In this case, the interior surfaces of the cutter cone 36 emerge from the hot isostatic pressing process in a near-net shape, and therefore do not require extensive finish machining.

There is a significant advantage of obtaining very hard bearing surfaces 38 and races 40, such as tungsten-carbide-cobalt, in the cutter cone 36. Namely, when such bearing surfaces and races have hard counterparts on the rock bit journal 12, then external lubrication and cooling may be affected by circulating drilling mud, rather than by an internal supply of a lubricant. This, of course, eliminates the need for a sealing device, such as an O-ring seal 20 (shown in FIG. 2), and eliminates problems associated with degradation or wear of the seal 20. Rock bits having no seal—but rather bearings open to the ambient environment—are known in the art as "open bearing" bits.

FIG. 7 (like the cone 10 in FIG. 4) is internally cladded through the powder metallurgy process; preferably a process that includes the hot isostatic pressing step. The forged mild steel drag bit core body 112 is provided with a machined chamber 118 and a nozzle bore 120. A counterbore 122 may also be machined in the body 112 to accommodate a threaded nozzle body (not shown). Obviously, the cladding 134 resists the abrasive effect of pressurized hydraulic drilling mud during a drilling operation. A "wash-out" of the internal nozzle cavity has been a problem with both rolling cone and drag-type rock bits, hence internally clad surfaces would inhibit this type of catastrophic damage to the cutting tools.

Figure 5:
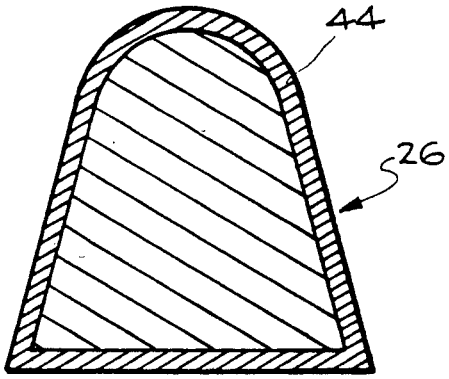
FIG. 5 is a schematic cross-sectional view of a tungsten-carbide-cobalt (cermet) insert, coated with a layer of nickel, which is incorporated in the cutter cone of the present invention.

Referring now to FIGS. 5 and 9, still another feature of the improved cutter cone 10 and drag bit 100 of the present invention is disclosed. In accordance with this feature, the tungsten-carbide-cobalt cutter inserts 26 (or the insert 150 of FIG. 9) have a thin coating or layer 44/143 of a material which prevents diffusion of carbon from the tungsten-carbide into the underlying steel core 28/128 during the high-temperature, hot isostatic pressing or sintering process. As is known, such diffusion has a significant driving force because the carbon content of the steel core 28/138 typically is low. Loss of carbon from the tungsten-carbide results in formation of the "eta" phase of the tungsten-carbide, which has significantly less desirable mechanical properties than the original tungsten-carbide insert.

It was discovered, in accordance with the present invention, however, that the above-noted diffusion, undesirable "eta" phase formation, and degradation of mechanical properties of the tungsten-carbide inserts 26/150 may be prevented by providing a layer of copper, copper alloys, silver, silver alloys, cobalt, cobalt alloys, tantalum, tantalum alloys, gold, gold alloys, palladium, palladium alloys, platinum, platinum alloys, and nickel or nickel alloys on the cutter inserts 26/150 before the inserts 26/150 are incorporated into the core 28/128.

Alternatively, a layer of graphite (not shown) also prevents degradation because it provides an alternate source of carbon. A layer of graphite is readily placed on or near the insert 26/150 by, for example, applying a suspension of graphite in a volatile solvent, such as ethanol, on the insert 26/150. The graphite prevents or reduces diffusion of carbon from the tungsten-carbide because it eliminates the driving force of the diffusion.

The other metals noted above prevent or reduce diffusion of carbon by virtue of the limited solubility of carbon in these metals at the temperatures and pressures which occur during the hot isostatic pressing process.

The metal coatings may be applied to the cutter inserts 26/150 by several methods, such as electroplating, eletroless plating, chemical vapor deposition, plasma deposition, and hot dipping. The metal layer or coating 44/143 on the cutter inserts is preferably approximately 25 to 100 microns (0.001" to 0.004") thick.

The metal layer 44/143, deposited on the cutter insert, preferably should not melt during the hot isostatic pressing or sintering process. It certainly must not boil during said processes. Nickel or nickel alloys are most preferred materials for the coating or layer 44/143 used in the present invention.

Figure 6:
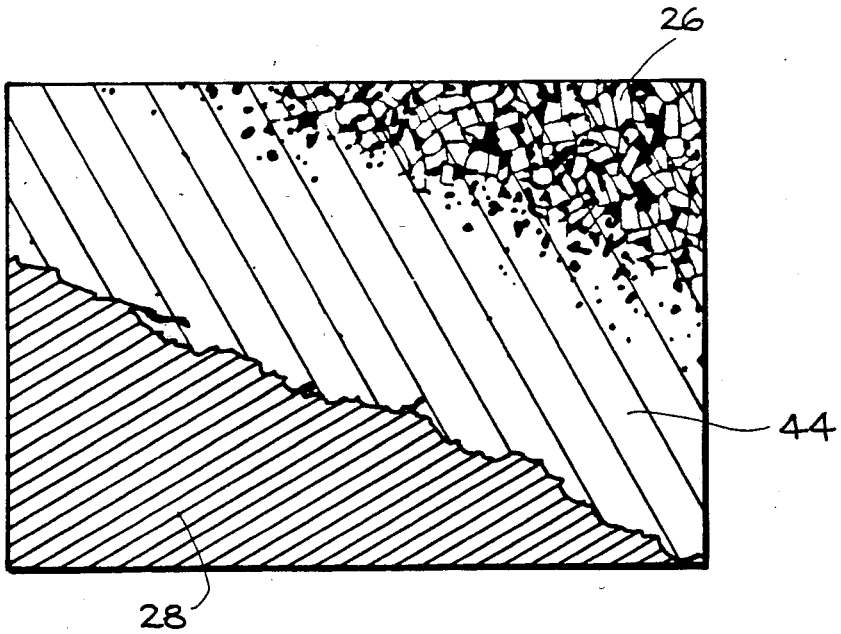
FIG. 6 is a schematic representation of a Scanning Electron Microscope (SEM) micrograph of the boundary layers between the tungsten-carbide-cobalt insert and a nickel coating on the one hand, and the nickel coating and underlying mild steel core on the other hand.

The metal coating 44/143 on the inserts 26/150 not only prevents the undesirable "eta" phase formation in the inserts 26/150, but also provides a transition layer of intermediate thermal expansion coefficient between the tungsten-carbide inserts 26/150 and the surrounding ferrous metal cladding 34/134 and core 28/128. In the absence of such a transition layer, the boundary cracks readily. Nevertheless, as it was noted above, test results in the absence of such a metal coating still show significant improvement over non-metallurgically bonded inserts with regards to the force required to dislodge the inserts 26/150. FIG. 6 schematically illustrates a Scanning Electron Microscope (SEM) micrograph of the boundary layers between the tungsten-carbide cutter insert 26/150 and a nickel layer 44/143 on the one hand, and the nickel layer 44/143 and the underlying core 28/128 on the other hand.

It will, of course, be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that, within the scope of the appended claims, the invention may be practiced otherwise than as specifically illustrated and described.

What is claimed is:

1. A cutter member of a rock bit, comprising:

a core, including an interior opening, wherethrough the cutter member may be mounted to a pin connected to a drill string, said core also including, on its exterior surface, a plurality of cavities;

a plurality of hard cutter inserts, the cavities and the cutter inserts having substantially matching dimensions so that the cutter inserts are accommodated in the cavities without substantial interference;

a cladding disposed on the exterior surface of the core, the cladding having been deposited by a powder metallurgy technique including a step wherein compacted powder of the cladding is heated to metallurgically bond said powder to the core, the cladding being substantially harder than the core, said cladding partially embedding the cutter inserts and metallurgically bonding said inserts to the core and to the cladding, and means disposed on the cutter inserts for substantially preventing diffusion of carbon from the cutter inserts into the core and the cladding during the step wherein compacted powder of the cladding is heated to metallurgically bond the same to the core.

2. The cutter member of claim 1, wherein the means comprise a layer disposed on the cutter inserts, the material of which is selected from a group consisting of graphite, copper, copper alloys, silver, silver alloys, cobalt, cobalt alloys, tantalum, tantalum alloys, gold, gold alloys, palladium, palladium alloys, platinum, platinum alloys, nickel, and nickel alloys.

3. The cutter member of claim 2, wherein the layer consists of nickel.

4. The cutter member of claim 3, wherein the layer is approximately 25 to 100 microns thick.

5. The cutter member of claim 1, wherein the cutter inserts comprise a cermet of tungsten-carbide and cobalt.

6. A cutter cone of a rock drilling bit used for drilling in subterranean formations and adapted for mounting to a journal leg of the rock drilling bit, the cone comprising:

a tough, shock-resistant steel core having an interior opening wherethrough the cone is rotatably mounted to the journal, and a plurality of cavities disposed on its exterior surface;

a plurality of hard cutter inserts comprising tungsten-carbide and being dimensioned for mounting into the exterior cavities of the core without substantial interference;

a cladding comprising material selected from a group consisting of tool steel and cermets, said cladding substantially covering the exterior surface of the core, partially embedding the cutter inserts and being metallurgically bonded thereto, having a hardness of at least 50 Rockwell C hardness units and having been deposited on the core by a powder metallurgy process, including a step of placing a suitable powder on the exterior surface of the core to which the inserts are mounted, and heating the powder to metallurgically bond the powder to the core, the cladding having substantially 100 percent density, and a coating disposed on the cutter inserts comprising a material which substantially prevents diffusion of carbon from the cutter inserts into the core during the powder metallurgy process.

7. The cutter cone of claim 6, wherein the material of the coating is selected from a group consisting of graphite, copper, copper alloys, silver, silver alloys, cobalt, cobalt alloys, tantalum, tantalum alloys, gold, gold alloys, palladium, palladium alloys, platinum, platinum alloys, nickel, and nickel alloys.

8. The cutter cone of claim 7, wherein the material of the coating is selected from a group consisting of nickel and nickel alloys.

9. The cutter cone of claim 6, further comprising a hard lining incorporated within the interior opening, said lining comprising a bearing surface for rotatably mounting the cone on the journal.

10. The cutter cone of claim 9, wherein the hard lining has been deposited on the core by a powder metallurgy process.

11. A cutter cone rotatably mountable on a journal of a rock bit of the type having a plurality of journals disposed angularly relative to the rotational axis of the rock bit, the cone comprising:

a tough, shock-resistant, solid steel core, the core having an interior opening wherethrough the cone is mounted on its respective journal, the core also having means disposed on its surface for accepting, through a slip fit, a plurality of cutter inserts;

a plurality of tungsten-carbide cutter inserts, each of the cutter inserts being mounted into the means disposed on the exterior surface of the core;

an exterior cladding disposed on the core partially embedding the cutter inserts, having a hardness of at least 50 Rockwell C units, said cladding having been deposited on the core by a powder metallurgy process including a step wherein a suitable metal powder is heated under high isostatic pressure to metallurgically bond said powder to the core and to metallurgically bond the cutter inserts to the core and cladding, and a thin layer of a diffusion preventing metal disposed between each cutter insert and the core, said layer comprising means for preventing diffusion of carbon from the tungsten-carbide insert into the core during the step of heating under high isostatic pressure.

12. The cutter cone of claim 11, wherein the means disposed on the surface of the cone comprise a plurality of apertures.

13. The cutter cone of claim 11, wherein the material of the cladding is tool steel.

14. The cutter cone of claim 13, wherein the metal of the cladding is selected from a group consisting of D2, M2, M42, S2 tool steel, and a tool steel composition consisting essentially of 2.45 percent carbon, 0.5 percent manganese, 0.9 percent silicon, 5.25 percent chromium, 1.3 percent molybdenum, 9 percent vanadium, 0.07 percent sulphur, and 80.53 percent iron.

15. The cutter cone of claim 14, wherein the metal of the cladding consists essentially of 2.45 percent carbon, 0.5 percent manganese, 0.9 percent silicon, 5.25 percent chromium, 1.3 percent molybdenum, 9 percent vanadium, 0.07 percent sulphur, and 80.53 percent iron.

16. The cutter cone of claim 13, wherein the thin layer of diffusion preventing metal is selected from a group consisting of graphite, copper, copper alloys, silver, silver alloys, cobalt, cobalt alloys, tantalum, tantalum alloys, gold, gold alloys, palladium, palladium alloys, platinum, platinum alloys, nickel, and nickel alloys.

17. The cutter cone of claim 16, wherein the thin layer of diffusion preventing metal is deposited on the cutter inserts prior to mounting the cutter inserts into the core.

18. The cutter cone of claim 17, wherein the thin layer of diffusion preventing metal is selected from a group consisting of nickel and nickel alloys, and wherein said layer is approximately 25 to 100 microns thick.

19. A process for making a cutter member of a rock bit of the type mounted through a pin to a drill string, the cutter member having a plurality of tungsten-carbide cutter inserts, the process comprising the steps of:

depositing a thin layer of a material selected from a group consisting of graphite, copper, copper alloys, silver, silver alloys, cobalt, cobalt alloys, tantalum, tantalum alloys, gold, gold alloys, palladium, palladium alloys, platinum, platinum alloys, nickel, and nickel alloys on the cutter inserts;

after said step of depositing, placing a plurality of the cutter inserts into cavities formed in the outer surface of the solid core of the cutter member, said cavities being dimensioned to accept the cutter inserts without substantial interference;

depositing a suitable powder composition on the outer surface of the core so as to partially embed the cutter inserts, and heating and pressing the powder in a suitable mold to metallurgically bond said powder and said cutter inserts to the member and thereby to provide an exterior cladding of the cutter member, said cladding having a hardness of at least 50 Rockwell C units, substantially conforming to the desired final exterior configuration of the cutter member, and being comprised of a material selected from a group consisting of metals and cermets.

20. The process of claim 19, wherein the material of the thin layer is selected from a group consisting of nickel and nickel alloys.

21. The process of claim 19, wherein the solid core comprises mild steel.

22. The process of claim 21, wherein the powder composition is selected from a group consisting of tungsten-carbide-cobalt cermet, titanium-carbide-nickel-molybdenum cermet, titanium-carbide-ferro alloy cermet, D2, M2, M42, S2 tool steels, and a tool steel composition consisting essentially of 2.45 percent carbon, 0.5 percent manganese, 0.9 percent silicon, 5.25 percent chromium, 1.3 percent molybdenum, 9 percent vanadium, 0.07 percent sulfur, and 80.53 percent iron.

23. The process of claim 19, further comprising the step of placing a suitable second powder composition within an interior opening of the solid core, and pressing the second powder composition to metallurgically bond the same to the core to provide a hard interior bearing surface within said core.

24. The process of claim 19, wherein the step of heating and pressing is conducted at approximately 15,000 to 30,000 PSI.

25. The process of claim 19, wherein the step of depositing a thin layer of material on the cutter inserts comprises electroplating.

26. A cutter cone to be mounted on a journal of a rock bit comprising:

a solid core including an interior opening wherethrough the cutter cone may be rotatably mounted to a journal of the rock bit, said core also including, on its exterior surface, a plurality of cavities;

a plurality of hard cutter inserts in the cavities in the core, and a powder metallurgy cladding metallurgically bonded on the exterior surface of the core, and comprising means for metallurgically bonding the cutter inserts to the core and to the cladding and for retaining the cutter inserts in the core.

27. A process for making a cutter cone for a rock bit of the type having at least one journal on which the cutter cone is rotatably mounted, the cutter cone having a plurality of cutter inserts, the process comprising the steps of:

placing a plurality of cutter inserts into cavities formed in the outer surface of a solid core of the cutter cone;

depositing a powder composition on the outer surface of the solid core so as to partially embed the cutter inserts;

pressing the powder in a mold to substantially conform to the desired final exterior configuration of the cutter cone, and heating the powder to bond said powder to the cone, an exterior cladding of the cutter cone being formed in said steps of heating and pressing, and said cladding serving as means for retaining and metallurgically bonding the cutter inserts in the cavities.

28. A drag-type rock bit comprising:

a drag bit core body forming an interior chamber therein, said core forming a first cutter end and a second pin end, said interior chamber being open to said pin end, said core further including, on its exterior surface at said first cutter end, a plurality of cavities;

a plurality of hard cutter inserts, the exterior cavities and the cutter inserts having substantially matching dimensions so that said cutter inserts are accommodated in the cavities without substantial interference;

a cladding disposed on at least the exterior surface of the core, the cladding having been deposited by a powder metallurgy technique including a step wherein compacted powder of cladding is heated to metallurgically bond said powder to the core, the cladding being substantially harder than the core, said cladding partially embedding the cutter inserts and comprising first means for metallurgically bonding said inserts to the core and to the cladding, and second means disposed on the cutter inserts for substantially preventing diffusion of carbon from the cutter inserts into the core and the cladding during the step wherein compacted powder of the cladding is heated to metallurgically bond the same to the core.

29. The drag bit of claim 28, wherein the second means comprise a layer disposed on the cutter inserts, the material of which is selected from a group consisting of graphite, copper, copper alloys, silver, silver alloys, cobalt, cobalt alloys, tantalum, tantalum alloys, gold, gold alloys, palladium, palladium alloys, platinum, platinum alloys, nickel, and nickel alloys.

30. The drag bit of claim 29, wherein the layer consists of nickel.

31. The drag bit of claim 30, wherein the layer is approximately 25 to 100 microns thick.

32. A drag bit type of a rock drilling bit used for drilling in subterranean formations, the bit comprising:

a core bit body comprising tough shock-resistant mild steel, having a first cutting end and a second pin end, said core further comprising an interior chamber formed therein, said second pin end being open to said chamber, and a plurality of cavities disposed on its exterior first cutting end surface;

a cladding comprising material selected from a group consisting of tool steel and cermets;

a plurality of hard cutter inserts being dimensioned for mounting into the exterior cavities of the first cutting end of said core without substantial interference, the cladding substantially covering the exterior first cutting end surface of the core, partially embedding the cutter inserts and being metallurgically bonded thereto, the cladding having a hardness of at least 50 Rockwell C hardness units and having been deposited on the core by a powder metallurgy process including a step of placing a suitable powder on the exterior surface of the core to which the inserts are mounted, and heating the powder to metallurgically bond the powder to the core, the cladding having substantially 100 percent density, the cutter inserts comprising tungsten-carbide, and further comprising a coating disposed on the inserts, said coating comprising a material which substantially prevents diffusion of carbon from the cutter insert into the core during the powder metallurgy process.

33. The cutter inserts of claim 32, wherein the material of the coating is selected from a group consisting of graphite, copper, copper alloys, silver, silver alloys, cobalt, cobalt alloys, tantalum, tantalum alloys, gold, gold alloys, palladium, palladium alloys, platinum, platinum alloys, nickel, and nickel alloys.

34. The cutter inserts of claim 33, wherein the material of the coating is selected from a group consisting of nickel and nickel alloys.

35. A drag bit type of rock bit comprising:

a tough, shock-resistant, solid steel core body, the core body having a first cutter end and a second pin end, said core defining an interior chamber opened to said second pin end of said core body, the core also having means disposed on its first cutter end surface for accepting, through a slip fit, a plurality of cutting inserts;

a plurality of tungsten-carbide cutter insert studs, said insert studs having a diamond cutting element metallurgically bonded to an end of said stud, each of the diamond inserts being mounted into the means disposed on the exterior first cutter end surface of the core;

an exterior cladding disposed on the core partially embedded the diamond cutter inserts, having a hardness of at least 50 Rockwell C units, said cladding having been deposited on the core by a powder metallurgy process including a step wherein a suitable metal powder is heated under high isostatic pressure to metallurgically bond said powder to the core and to metallurgically bond the cutter inserts to the core and cladding;

a means for protecting the diamond cutting elements bonded to said tungsten-carbide stud during said cladding process, and a thin layer of a diffusion-preventing metal disposed between each diamond cutter insert stud and the core, said layer comprising means for preventing diffusion of carbon from the tungsten-carbide insert stud into the core during the step of heating under high isostatic pressure.

36. The drag bit of claim 35, wherein the means disposed on the surface of the cone comprise a plurality of apertures.

37. The drag bit of claim 35, wherein the metal of the cladding is a tool steel.

38. The drag bit of claim 37, wherein the metal of the cladding is selected from a group consisting of D2, M2, M42, S2 tool steel, and a tool steel composition consisting essentially of 2.45 percent carbon, 0.5 percent manganese, 0.9 percent silicon, 5.25 percent chromium, 1.3 percent molybdenum, 9.0 percent vanadium, 0.07 percent sulfur, and 80.53 percent iron.

39. The drag bit of claim 38, wherein the metal of the cladding consists essentially of 2.45 percent carbon, 0.5 percent manganese, 0.9 percent silicon, 5.25 percent chromium, 1.3 percent molybdenum, 9.0 percent vanadium, 0.07 percent sulfur, and 80.53 percent iron.

40. The tungsten-carbide studs of the diamond inserts of claim 37, wherein the thin layer of diffusion-preventing metal is selected from a group consisting of copper, copper alloys, silver, silver alloys, cobalt, cobalt alloys, tantalum, tantalum alloys, gold, gold alloys, palladium, palladium alloys, platinum, platinum alloys, nickel, and nickel alloys.

41. The tungsten-carbide studs of the diamond inserts of claim 40, wherein the thin layer of diffusion-preventing metal is deposited on the cutter inserts prior to mounting the cutter inserts into the core.

42. The tungsten-carbide studs of the diamond inserts of claim 41, wherein the thin layer of diffusion-preventing metal is selected from a group consisting of nickel and nickel alloys, and wherein said layer is approximately 25 to 100 microns thick.

43. A process for making a drag bit type of rock bit, said drag bit having a plurality of tungsten-carbide diamond-tipped cutter insert studs, the process comprising the steps of:

depositing a thin layer of a material selected from a group consisting of graphite, copper copper alloys, silver, silver alloys, cobalt, cobolt alloys, tantalum, tantalum alloys, gold, gold alloys, palladium, palladium alloys, platinum, platinum alloys, nickel and nickel alloys on the diamond tipped cutter insert studs;

placing a plurality of the diamond tipped cutter insert studs into cavities formed into an outer surface of a first cutter end of a solid core of a drag bit body, said cavities being dimensioned to accept the diamond tipped cutter insert studs with a slip fit, the diamond tipped cutter insert studs having the thin layer of the material selected from the group consisting of graphite, copper, copper alloys, silver, silver alloys, cobalt, cobalt alloys, tantalum, tantalum alloys, gold, gold alloys, palladium, palladium alloys, platinum, platinum alloys, nickel and nickel alloys;

depositing a suitable powder composition on the outer surface of the drag bit body;

first, heating and pressing the powder in a suitable mold to metallurgically bond said powder to the drag bit body and thereby to provide an exterior cladding of the body, said cladding having a hardness of at least 50 Rockwell C units, substantially conforming to the desired final exterior configuration of the drag bit, and being comprised of a material selected from a group consisting of metals and cermets, and second, a step comprising means for heating and pressing the powder in said mold sufficiently to bond said diamond insert studs to said outer surface of said drag bit body in a two-step process, without destroying the diamond cutting elements metallurgically bonded to said tungsten-carbide studs.

44. The process of claim 43, wherein the step of depositing a thin layer of material on the diamond cutter inserts comprises electroplating.

45. The process of claim 43, wherein the material of the thin layer is selected from a group consisting of nickel and nickel alloys.

46. The process of claim 43, wherein the solid core is a mild steel core.

47. The process of claim 46, wherein the powder composition is selected from a group consisting of tungsten-carbide-cobalt cermet, titanium-carbide-nickel-molybdenum cermet, titanium-carbide-ferro alloy cermet, D2, M2, M42, S2 tool steels, and a tool steel composition consisting essentially of 2.45 percent carbon, 0.5 percent manganese, 0.9 percent silicon, 5.25 percent chromium, 9.0 percent vanadium, 1.3 percent molybdenum, 0.07 percent sulfur, and 80.53 percent iron.

48. A process for making a drag bit type of rock bit, said drag bit having a plurality of diamond tipped tungsten-carbide studded inserts in a cutter end of said drag bit, the process comprising the steps of:

depositing a thin layer of a metallic material on the tungsten-carbide studs minus their diamond cutting tips;

placing a plurality of said coated tungsten-carbide studs into an outer surface of a first cutter end of a solid core of a drag bit body, said cavities being dimensioned to accept the coated tungsten-carbide studs with a slip fit;

depositing a suitable powder composition on the outer surface of the drag bit body;

heating said powder composition between 1900° F. and 2300° F. in a suitable mold for 4 to 10 hours;

pressing said powder composition during said heating cycle between 15,000 and 30,000 pounds per square inch to consolidate said powder composition on said drag bit body providing an exterior cladding thereon, said cladding having a hardness of at least 50 Rockwell C units, substantially conforming to the desired final exterior configuration of the drag bit, and being comprised of a material selected from a group consisting of metals and cermets; and pressing and heating, in a separate cycle, diamond cutting tips to said coated tungsten-carbide studs, a nickel shim is first placed between each of said diamond cutting tips and said tungsten-carbide studs, said heating cycle having temperatures between 1200° F. (650° C.) and 1385° F. (750° C.) for 0.5 to 4 hours, said pressing cycle taking place simultaneously with said heating cycle, said pressing cycle having pressures between 15,000 and 30,000 pounds per square inch to bond said diamond tips to said studs.

49. The process of claim 48, wherein said metallic material deposited on said tungsten-carbide studs is selected from a group consisting of graphite, copper, copper alloys, silver, silver alloys, cobalt, cobalt alloys, tantalum, tantalum alloys, gold, gold alloys, palladium, palladium alloys, platinum, platinum alloys, nickel, and nickel alloys.

50. The process of claim 49, wherein the step of depositing a thin layer of material on the tungsten-carbide stud bodies of said diamond cutter inserts comprises electroplating.

51. The process, as set forth in claim 48, wherein the temperature of the heating cycle of the powder composition is about 2150° F.

52. The process, as set forth in claim 48, wherein the pressure utilized to consolidate said powder composition during the heat cycle is about 15,000 pounds per square inch.

53. The process, as set forth in claim 48, wherein the diamond cutting tips are bonded and heated in a separate cycle, said diamond cutting tips are silver brazed to said tungsten-carbide studs at a temperature of about 650° F., the pressing of said diamond tip to said tungsten-carbide stud during the heating cycle is about 15,000 pounds per square inch.

54. A process for making a drag bit type of rock bit, said drag bit having a plurality of projections extending from a body of said drag bit at a cutting end of said drag bit, the process comprising the steps of:

depositing a suitable powder composition on the outer surface of the drag bit body;

heating said powder composition between 1900° F. and 2300° F. in a suitable mold for 4 to 10 hours;

pressing said powder composition during said heating cycle between 15,000 and 30,000 pounds per square inch to consolidate said powder composition on said drag bit body providing an exterior cladding thereon, said cladding having a hardness of at least 50 Rockwell C units, substantially conforming to the desired final exterior configuration of the drag bit, and being comprised of a material selected from a group consisting of metals and cermets, and pressing and heating, in a separate cycle, diamond cutting tips to said projections extending from the cutting end of said drag bit, a nickel shim is first placed between each of said projections, said heating cycle having temperatures between 1200° F. (650° C.) and 1385° F. (750° C.) for 0.5 to 4 hours, said pressing cycle taking place simultaneously with said heating cycle, said pressing cycle having pressures between 15,000 and 30,000 pounds per square inch to bond said diamond tips to said studs.

55. The process, as set forth in claim 54, wherein said diamond cutting tips bonded to said projections on said drag bit are heated in a heating cycle to about 1200° F. for about 2 hours.

56. The process, as set forth in claim 54, wherein said diamond tips bonded to said projections extending from said drag bit are pressed during the heating cycle to a pressure of about 15,000 pounds per square inch.

57. The process, as set forth in claim 54, wherein the diamond cutting tips are silver brazed to said projections at a temperature of about 650° F. at a pressure of about 15,000 pounds per square inch.

* * * * *